US006839920B2

(12) United States Patent
Schulte

(10) Patent No.: US 6,839,920 B2
(45) Date of Patent: Jan. 11, 2005

(54) FASTENER AND SUPPORT LEG FOR ADJUSTABLE CROSS BAR FOR BED RAILS AND FRAMES

(75) Inventor: John K. Schulte, O'Fallon, MO (US)

(73) Assignee: Fredman Bros. Furniture Company, Inc., St. Louis, MO (US)

( * ) Notice: Subject to any disclaimer, the term of this patent is extended or adjusted under 35 U.S.C. 154(b) by 2 days.

(21) Appl. No.: 10/357,073

(22) Filed: Feb. 3, 2003

(65) Prior Publication Data

US 2004/0148701 A1 Aug. 5, 2004

(51) Int. Cl.[7] ..... A47C 19/02

(52) U.S. Cl. ..... 5/200.1; 5/203; 5/286; 5/305

(58) Field of Search ..... 5/201, 200.1, 285, 5/286, 305, 203

(56) References Cited

U.S. PATENT DOCUMENTS

| | | | | |
|---|---|---|---|---|
| 2,877,470 | A | | 3/1959 | Roth et al. |
| 3,031,689 | A | | 5/1962 | Sark |
| RE27,182 | E | | 9/1971 | Fredman |
| 3,646,623 | A | | 3/1972 | Harris et al. |
| 3,761,970 | A | | 10/1973 | Fredman |
| 3,803,644 | A | | 4/1974 | Harris |
| 3,848,280 | A | | 11/1974 | Allen et al. |
| 3,945,064 | A | | 3/1976 | Harris et al. |
| 4,027,343 | A | | 6/1977 | Hooker |
| 4,038,710 | A | | 8/1977 | Tambascio |
| 4,078,271 | A | | 3/1978 | Tambascio |
| 4,080,674 | A | | 3/1978 | Fredman et al. |
| 4,103,374 | A | | 8/1978 | Knoke |
| 4,135,266 | A | | 1/1979 | Knoke |
| 4,276,665 | A | | 7/1981 | Mis |
| 5,203,039 | A | | 4/1993 | Fredman |
| 5,231,713 | A | | 8/1993 | McDonnell |
| 5,243,720 | A | | 9/1993 | Harrow |
| 5,477,571 | A | | 12/1995 | Roggenkamp et al. |
| 5,502,852 | A | | 4/1996 | Fredman et al. |
| 5,815,860 | A | | 10/1998 | Mitchell |
| 5,894,614 | A | | 4/1999 | Stroud |
| 5,996,145 | A | | 12/1999 | Taylor |
| 6,115,858 | A | | 9/2000 | Mitchell |
| 6,125,484 | A | * | 10/2000 | Thomson ..... 5/200.1 |
| 6,209,155 | B1 | | 4/2001 | Epstein et al. |
| 6,289,535 | B1 | | 9/2001 | Hernandez |
| 6,397,413 | B2 | | 6/2002 | Epstein et al. |

OTHER PUBLICATIONS

"Muscle 2000" Advertisement, date unknown.

Glideaway's "Fit For A Queen" Brochure, date unknown.

Glideaway's "Bed Rails and Frames Require Rigid Center Support to Protect Queen Size Beds and Bedding" , date unknown.

* cited by examiner

*Primary Examiner*—Frederick L. Lagman
(74) *Attorney, Agent, or Firm*—Polster, Lieder, Woodruff & Lucchesi, L.C.

(57) ABSTRACT

An adjustable locking mechanism incorporated in a bracket embracing laterially slidable first and second members, said mechanism being incorporated in the bracket and having a first element engaged with the bracket and a second element engaged with the first element and movable through both the first element and the bracket into engagement with the first member to force the first member into engagement with the second member to hold said first and second members in fixed lateral relationship to each other.

14 Claims, 2 Drawing Sheets

FASTENER AND SUPPORT LEG FOR ADJUSTABLE CROSS BAR FOR BED RAILS AND FRAMES

CROSS-REFERENCE TO RELATED APPLICATIONS

STATEMENT REGARDING FEDERALLY SPONSORED RESEARCH OR DEVELOPMENT

Not Applicable.

BACKGROUND OF THE INVENTION

1. Field of the Invention

This invention relates to beds and bed frames which have metal or wooden bed rails and to metal adjustable cross bars with legs for supporting the cross bars. While this invention is particularly applicable to full, queen, California king and king size beds which require legs on the cross bars to support the extra width and weight of such beds and bedding, it also is applicable to twin size beds where legs may be desired.

Specifically, this invention is related to adjustable angle iron cross bars for bed rails and frames designed for use with various sized beds and to a fastener for connecting the parts of the adjustable angle iron cross bars together, which fastener has a support leg fastened thereto.

2. Description of the Prior Art

Conventional beds and bed rails require longitudinally spaced, transversely extending wooden or metal slats extending between the side rails. The side rails tend to warp, twist outwardly or deflect under the weight of the box spring and other bedding components, which causes the box spring to sag. This especially is a problem with wider span beds and bedding, such as, queen size and king size widths, since the wider bedding is heavier as well as being wider and longer. Slats setting on angle iron or wood rails not only push the rails downwardly, but also push the rails outwardly when weight or torquing of these rails frequently cause the bed legs to split when the slot in the legs of the beds is too close to the outside edge of the leg, or cause the bed legs to split away from the end board. These slats are normally 1" thick or less and create a sway in the box spring between one slat and the next, thereby weakening the frame of the box spring.

Prior U.S. Pat. No. 4,080,674 issued Jan. 3, 1977 discloses metal bed rails for queen size beds which eliminate the use of transverse slats and are interconnected by a centrally located angle iron rigid cross member with legs and adjustable glides. By extending the threaded glides to contact the floor they prevent the box spring from sagging and eliminate undue stress on the side rails and bed legs.

U.S. Pat. No. 5,203,039 discloses an adjustable cross bar and foldable adjustable legs. U.S. Pat. No. 5,502,852 is an improvement on the adjustable leg structure of U.S. Pat. No. 5,203,039. U.S. Pat. No. 6,209,155 is an improvement on the adjustable cross bar shown in U.S. Pat. No. 5,203,039 and U.S. Pat. No. 6,397,413 is an improvement on U.S. Pat. No. 6,209,155 in that it provides for the installation of the leg on the fastener which holds the cross bar members together.

U.S. Pat. Nos. 5,203,039; 5,502,852; 6,209,155; and 6,397,413 are owned by the assignee of this application. The present invention is an improvement on the support legs shown in the aforementioned patents in that it provides for the leg being riveted to the fastener which is a relatively inexpensive fastening technique compared to the spot welding required in U.S. Pat. No. 6,397,413. It also is fabricated at the factory and does not require assembly in the field, saving on installation costs by the installer.

BRIEF SUMMARY OF THE INVENTION

It is a primary object of the present invention to provide a cross bar construction, especially for full, king, California king, and queen size beds, which is adjustable in width and height, and which is easily and inexpensively fabricated at the factory.

Another object is to provide an adjustable cross bar construction for bed frames in which a leg is riveted to the bracket which slidingly retains the free ends of the cross bar members. These and other objects will become apparent hereinafter.

This invention comprises a bed frame cross bar having relatively expandable members and a locking bracket for retaining the expandable members in a fixed position with a leg riveted to the locking member by a relatively inexpensive and accurate technique at the place of fabrication.

BRIEF DESCRIPTION OF THE SEVERAL VIEWS OF THE DRAWINGS

In the drawings wherein like numbers refers to like parts wherever they occur.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention.

Figure 4:
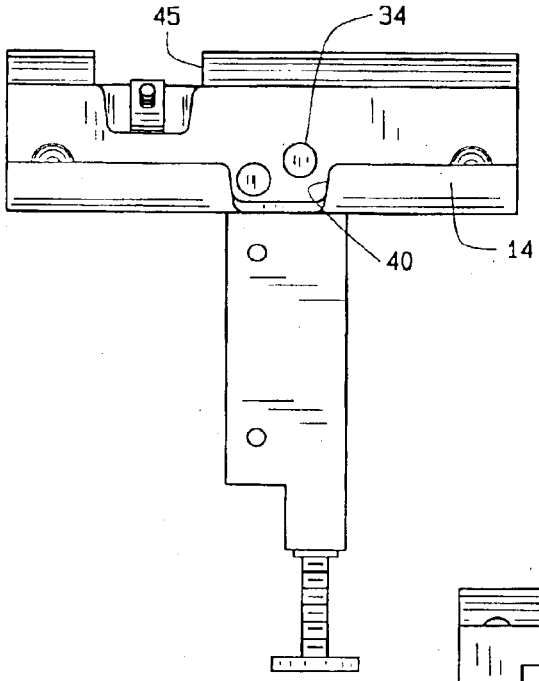
FIG. 4 is a front elevational view of the cross bar shown in FIG. 1.
Figure 5:
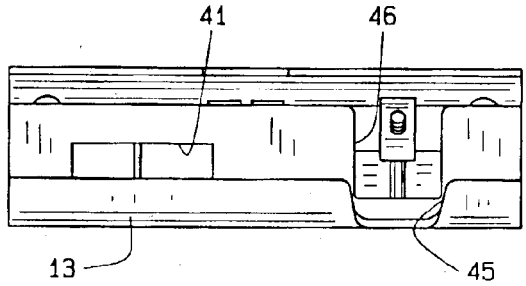
FIG. 5 is a plan view of the connecting member shown in FIG. 1.

This invention is an improvement on the adjustable cross bar connector shown in detail in FIG. 4 of U.S. Pat. No. 5,203,039 and identified by numerals 20–25 of that patent and on the connector identified by the numerals 100 et. seq. in U.S. Pat. Nos. 6,209,155 and 6,397,413. The structures of U.S. Pat. Nos. 5,203,039, 5,502,852, 6,209,155 and 6,397,413 are herein incorporated by reference to the extent necessary to define background for a completion of the present disclosure.

Figure 3:
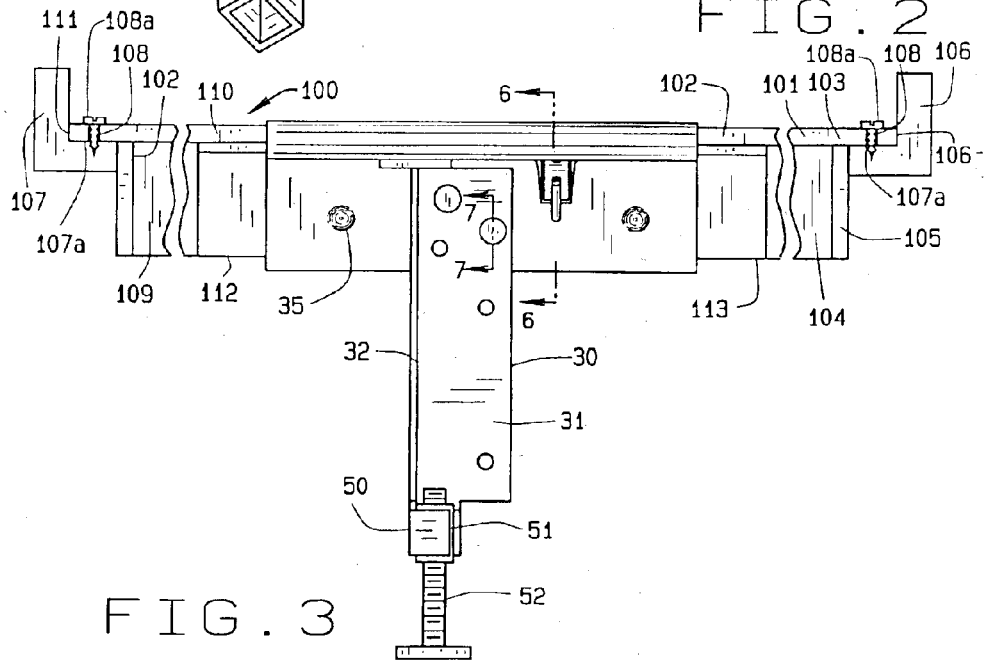
FIG. 3 is a fragmentary front elevation view of this invention as shown in FIG. 2.

FIG. 3 shows a cross-bar 100 which comprises a main cross bar member 101 and an adjustable cross bar member 102.

The main cross bar member 101 is an "L" angle, which has a horizontal flange or web 103 and a right angle vertical flange or web 104. The vertical flange 104 terminates at 105 inwardly from the outboard edge 106 of the horizontal flange 103. This defines a cut-out area which engages the inside of side rail 107 while the horizontal flange 103 has an opening 108 which overlaps the lip 107*a* of the side rail 107 and accommodates a screw 108*a* or other suitable means for fastening the main cross member 101 to the side rail 107. The adjustable cross bar member 102 likewise has a vertical flange 109 and a horizontal flange 110. The flanges 103,110 and 104,109 are of approximately equal size. The outboard end 111 of the adjustable cross member 102 is of similar construction to the outboard edge 106 of the main flange 101 and includes an opening 108 to accommodate a screw 108*a* or other suitable fastener to attach the cross bar 102 to the side rail lip 107*a*. When the side rails 107 and lips 107*a* are wood, screws are used to fasten the cross bars members 101,102 to the lips 107*a*. When the side rails 107 and lips 107*a* are metal, bolts and nuts are used.

The novel bracket 10 of this invention is used to tie the cross bar members 101 and 102 together at their inboard or free ends 112 and 113. The bracket 10 preferably is about five inches in length for a bed cross bar, but can be any length for other applications as long as it is sufficiently long to provide rigidity and strength to the extended cross bar.

The horizontal flange 103 of the cross bar member 101 has a longitudinal free edge 115 while the vertical flange 104 has a longitudinal free edge 116. The horizontal flange 110 of the adjustable cross bar member 102 has a longitudinal free edge 117 and the vertical flange 109 has a longitudinal free edge 118. This is more clearly shown in FIG. 2.

Figure 1:
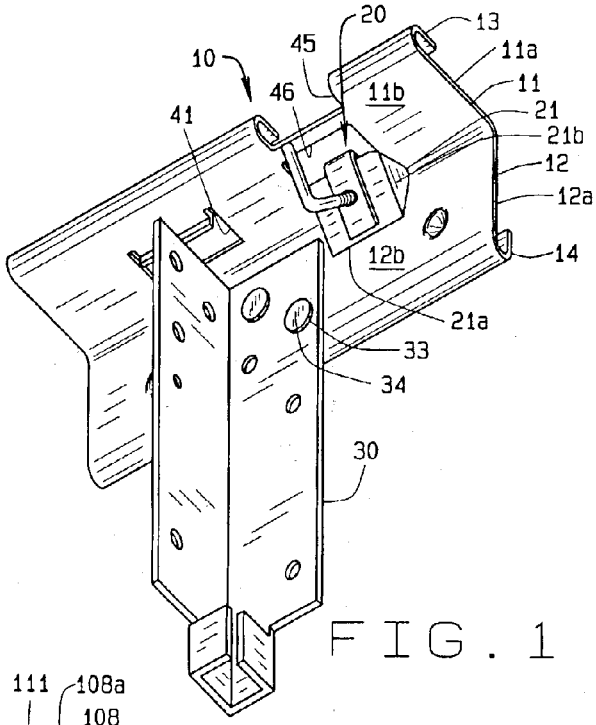
FIG. 1 is a perspective view of the leg and locking member which is the subject of this invention.
Figure 2:
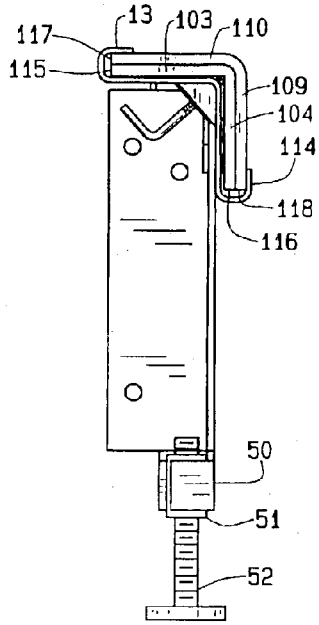
FIG. 2 is an end elevational view of this invention applied to two relatively slidable cross bar members.

As seen more clearly in FIG. 1, the bracket 10 comprises right angular flanges 11 and 12. The flange 11 is horizontal and the flange 12 depends therefrom at a right angle. The free edges of the flanges 11 and 12 are turned backwardly over the outer surfaces 11*a,* 12*a* of the flanges 11,12 to form a horizontal track 13 and a vertical track 14, respectively. The track 13 embraces the free ends 115 and 117 of the cross bar flange members 103,110 and the track 14 braces the free ends 116,118 of the cross bar flange members 104,109, respectively. This is seen in FIG. 2. This allows the members 101,102 to be relatively movable through the tracks 13,14, thus allowing the members 101,102 to be sized to fit the distance between the side rails 107.

Figure 6:
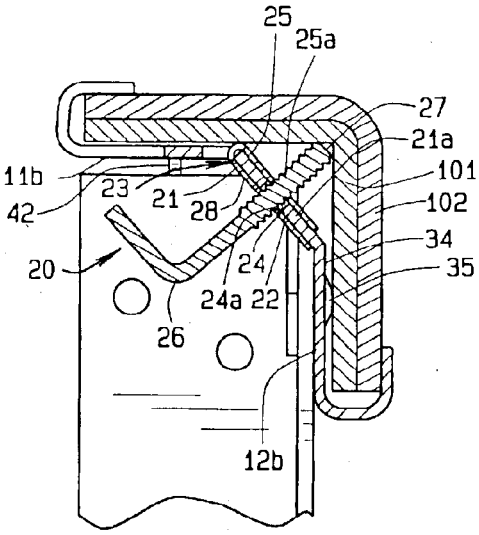
FIG. 6 is a vertical sectional view taken on line 6—6 of FIG. 3.

An adjustable locking mechanism 20 is incorporated into the bracket 10 (FIG. 6) and is positioned adjacent to the flange inside surfaces 11*b* and 12*b*. A boss or gusset 21 is formed in the flange 12 on the inside surface 12*b* thereof. The boss 21 has a rectangular base 21*a* and triangular sides 21*b*(FIG. 1). An opening 22 is formed in the base 21*a* of the boss 21 and a Tinnerman nut 23 is positioned over the base 21*a* and frictionally engages the front and backsides thereof. The Tinnerman nut 23 has legs 24,25 provided with openings 24*a* and 25*a*. The openings 24*a,* 25*a* are sized to mate with the boss opening 22. The leg 25 has outwardly flared edges around the opening 25*a* which act as a lock nut for an L-shaped threaded bolt or elbow 26 which is positioned through the openings 22*a,*24*a,*25*a*. When the elbow 26 is tightened its end 27 engages the inside surface of the cross bar member 101 to lock the cross bar members 101,102 into frictional engagement with the bracket 10.

The tracks 13 and 14 are sized to accommodate the cross bar members 101 and 102 in a relatively sliding arrangement.

When the cross bar member ends are firmly seated against the inside edges of the bed rails 107 and attached by the screws 108*a,* they will resist rotation or other movement. An important aspect of this invention is that the bracket horizontal flange 11 and the cross bar member horizontal flanges 103,110 are aligned so that the weight of the spring, mattress and users urges them into frictional engagement and strengthens the grip of the elbow 26 against the inner surface 112 of the cross member flange 103.

An important improvement of this application is the way the leg 30 is attached to the fastening bracket 10. In U.S. Pat. No. 6,397,413, the leg is welded to the fastening member in any of several different ways. Spot welding is an expensive way of attaching metal parts together and requires considerable time and skill on the part of the welder. In the present application, the leg 30 is riveted to the bracket 10. Riveting is less costly and requires less skill and is more easily automated.

Figure 7:
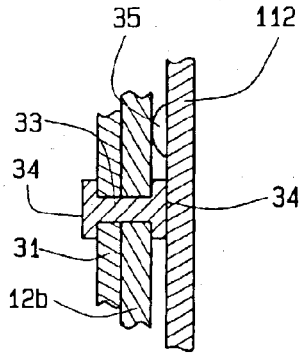
FIG. 7 is a sectional view taken on line 7—7 of FIG. 3.

The leg 30 is formed of hot rolled steel and has right angular flanges 31 and 32. The flange 31 has rivets 33 applied to fasten the leg 30 to the leg bracket flange 12. The rivets 33 have heads 34 which are positioned on the outside of the flange 31 and the inside of the vertical bracket flange 12, i.e., between the flange 12 and the inside cross bar member 112. To provide ease of engagement the rivet heads 34 and the cross bar member 112, protrusions or dimples 35 are formed in the bracket flange 12*b*. The dimples 35 are deeper than the thickness of the rivet heads 34 and therefore the cross bar members 101,112 slide on the tops of the dimples 35 and do not hang up on the wide flat rivet heads 34 (FIG. 7).

To facilitate securing the leg 30 to the bracket 10, an opening 40 is formed in the bracket vertical flange track 14 (FIG. 4). It is aligned with the rivet heads 34. The opening 40 allows access to the rivet heads 34 on the bracket 10 to facilitate the riveting process. An opening 41 is formed in the bracket horizontal flange 11 and a downwardly depending stabilizing flange 42 (FIG. 1) is formed which tends to prevent leg deformation if lateral load is applied to the leg 30, e.g., by dragging the leg 30 across a floor.

To facilitate installation of the Tinnerman nut 23, an opening 45 is formed in the bracket horizontal track 13. The opening 45 is aligned with the boss 21. An opening 46 is formed in the horizontal flange 11 aligned with the boss 21 to also facilitate installation of the Tinnerman nut 23.

The free end of the leg 30 has a square bracket 50 which retains a threaded plastic nut 51 which holds an extensible foot 52 which is threaded to move in and out to thereby change the length of the leg 30 and provide firm support for the cross bar.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. In the combination of interlocking laterally adjustable first and second members and a bracket for retaining the laterally adjustable first and second members in a laterally adjusted position wherein the first member is slidable laterally within the second member and the bracket embraces portions of the first and second members and retains the said members in sliding relationship, the improvement which comprises a gusset formed on the bracket and an adjustable locking mechanism incorporated in the bracket and having a first lock element frictionally engaged with the gusset and a second element freely moveable through the gusset and engaged with the first element and movable through both the first element and the gusset into engagement with the first member to force the first member into engagement with the second member to lock said first and second members in fixed lateral relationship to each other, the first and second members being freely adjustable with respect to lateral length.

2. The combination of claim 1 wherein the first element includes a threaded locking area and the second element is threaded and engages the threaded locking area to urge and retain the adjustable members in locked position.

3. The combination of claim 1 including a leg riveted to the bracket and means spacing the bracket from the sliding members a distance greater than the thickness of the rivet head.

4. The combination of claim 1 wherein the bracket has right angular flanges, the gusset being formed in one of said flanges extending toward the other said flange and the first element of the adjustable locking mechanism is frictionally mounted on said gusset and the second element of said locking mechanism passes freely through the gusset.

5. The combination of claim 4 wherein the first and second members each have right angular flanges juxtaposed to each other and to the right angular flanges of the bracket.

6. In the combination of interlocking laterally adjustable first and second members and a bracket for retaining the laterally adjustable first and second members in a laterally adjusted position wherein the first member is slidable laterally within the second member and the bracket embraces portions of the first and second members and retains the said members in sliding relationship, the improvement which comprises an adjustable locking mechanism incorporated in the bracket and having a first element engaged with the bracket, a second element engaged with the first element and movable through both the first element and the bracket into engagement with the first member to force the first member into engagement with the second member to hold said first and second members in fixed lateral relationship to each other, a leg riveted to the bracket, and a depending stabilizing flange formed in the bracket and aligned with the leg to prevent deformation of the leg under lateral load.

7. In the combination of interlocking laterally adjustable first and second members and a bracket for retaining the laterally adjustable first and second members in a laterally adjusted position wherein the first member is slidable laterally within the second member and the bracket embraces portions of the first and second members and retains the said members in sliding relationship, the improvement which comprises an adjustable locking mechanism incorporated in the bracket and having a first element engaged with the bracket, a second element engaged with the first element and movable through both the first element and the bracket into engagement with the first member to force the first member into engagement with the second member to hold said first and second members in fixed lateral relationship to each other, the first and second members each having a horizontal flange and a vertical flange adjacent to each other, the bracket having a horizontal flange and a vertical flange adjacent to the horizontal flange and vertical flange of the first member, and a leg riveted to the vertical flange of the bracket, the rivet having a head positioned between the vertical flange of the bracket and the vertical flange of the first member, and spacing elements on one of the vertical flanges of the bracket and the first member spacing said vertical flanges a distance greater than the thickness of the rivet head to allow the first element to move through the bracket without interference from the rivet head.

8. In the combination of interlocking laterally adjustable first and second members and a bracket for retaining the laterally adjustable first and second members in a laterally adjusted position wherein the first member is slidable laterally within the second member and the bracket embraces portions of the first and second members and retains the said members in sliding relationship, the improvement which comprises an adjustable locking mechanism incorporated in the bracket and having a first element engaged with the bracket and a second element engaged with the first element and movable through both the first element and the bracket into engagement with the first member to force the first member into engagement with the second member to hold said first and second members in fixed lateral relationship to each other, the bracket having right angular flanges, a gusset being formed in one of said flanges extending toward the other said flange and the first element of the adjustable locking mechanism being mounted on said gusset and the second element of said locking mechanism passing through the gusset, the first and second members each having right angular flanges juxtaposed to each other and to the right angular flanges of the bracket, a leg, at least one rivet connecting said leg to one of said bracket flanges, said rivet having a head between the bracket flange on which said leg is mounted and the adjacent member flanges and a spacing element spacing said flanges a distance greater than the thickness of the rivet head to allow the first element to move through said bracket without interference with the rivet head.

9. In the combination of interlocking laterally adjustable first and second members and a bracket for retaining the laterally adjustable first and second members in a laterally adjusted position wherein the first member is slidable laterally within the second member and the bracket embraces portions of the first and second members and retains the said members in sliding relationship, the improvement which comprises an adjustable locking mechanism incorporated in the bracket and having a first element engaged with the bracket and a second element engaged with the first element and movable through both the first element and the bracket into engagement with the first member to force the first member into engagement with the second member to hold said first and second members in fixed lateral relationship to each other, the bracket having right angular flanges, a gusset being formed in one of said flanges extending toward the other said flange and the first element of the adjustable locking mechanism being mounted on said gusset and the second element of said locking mechanism passing through the gusset, the first and second members each having right angular flanges juxtaposed to each other and to the right angular flanges of the bracket, wherein the bracket is inside the nested first and second members and the free edges of the bracket flanges are turned outwardly into U-shaped tracks to embrace longitudinal free edges of the first and second members allowing said members to move longitudinally with respect to each other in said tracks.

10. The combination comprising a first member having right angular flanges, a second member having right angular flanges nested on the outer surface of the first member and longitudinally movable with respect to said first member, a bracket having right angular flanges positioned adjacent to the inside surfaces of the flanges of the first member, the bracket flanges having free longitudinally edges which are turned outwardly into U-shaped channels which embrace the longitudinal edges of the flanges of the nested first and second members, a boss formed on one of the bracket flanges and extending toward the other of said bracket flanges, an adjustable locking mechanism body mounted on said boss and having a threaded elbow which is advanced through the locking mechanism body into engagement with the inside surface of said first member to urge the first member toward the second member and lock said first and second members in non-slidable relation, the U-shaped track on the bracket flange on which said boss is formed having a cutout area to facilitate installation of said locking mechanism.

11. The combination of claim 10 including a leg riveted to one of the bracket flanges and the U-shaped track on said flange opposite to said rivet head having a cut-out area to facilitate installation of said rivet.

12. The combination of claim 11 including a depending stabilizing member formed in one of the bracket flanges and aligned with the top of the leg to prevent deformation of the leg under lateral load.

13. The combination of claim 11 including an extensible element on the leg to adjust the length of the leg.

14. The combination of claim 11 including an opening in the said other bracket flange opposite to said boss to facilitate installation of the adjustable locking mechanism body on said boss.

* * * * *